US010532243B2

(12) United States Patent
Littlejohn

(10) Patent No.: US 10,532,243 B2
(45) Date of Patent: Jan. 14, 2020

(54) CABLE ATTACHABLE FOREARM COVER ASSEMBLY

(71) Applicant: Vincent Littlejohn, Los Angeles, CA (US)

(72) Inventor: Vincent Littlejohn, Los Angeles, CA (US)

( * ) Notice: Subject to any disclaimer, the term of this patent is extended or adjusted under 35 U.S.C. 154(b) by 114 days.

(21) Appl. No.: 15/820,439

(22) Filed: Nov. 22, 2017

(65) Prior Publication Data

US 2019/0151704 A1 May 23, 2019

(51) Int. Cl.
*A63B 21/00* (2006.01)
*A63B 21/062* (2006.01)

(52) U.S. Cl.
CPC ..... *A63B 21/4021* (2015.10); *A63B 21/062* (2013.01); *A63B 21/151* (2013.01); *A63B 21/4027* (2015.10); *A63B 21/4043* (2015.10)

(58) Field of Classification Search
None
See application file for complete search history.

(56) References Cited

U.S. PATENT DOCUMENTS 2,274,574 A * 2/1942 Zerne ..... A61H 1/02 482/129
3,089,700 A * 5/1963 Hotas ..... A63B 23/1245 482/94
4,123,052 A * 10/1978 Perkins ..... A61F 5/373 446/26
5,048,825 A * 9/1991 Kelly ..... A63B 21/154 482/904
5,501,656 A * 3/1996 Homma ..... A61H 1/02 601/33
5,626,544 A * 5/1997 Foresto ..... A63B 21/0552 482/10
6,168,556 B1 1/2001 Saavedra
7,364,555 B1 * 4/2008 Davidson ..... A61H 1/0274 482/131
7,662,073 B1 * 2/2010 Baldwin ..... A63B 21/4021 482/139
D668,396 S 10/2012 Shamis et al.
8,337,371 B2 12/2012 Vollmer, Jr.
9,205,016 B2 * 12/2015 Laflin ..... A61H 1/0277
9,295,869 B2 3/2016 Washington
9,724,551 B2 * 8/2017 Foster ..... A63B 21/0023
9,861,851 B1 * 1/2018 Owens ..... A63B 21/065
2010/0285936 A1 * 11/2010 Tacker ..... A63B 21/0602 482/105
2015/0148204 A1 5/2015 Sleppy

* cited by examiner

*Primary Examiner* — Stephen R Crow

(57) ABSTRACT

A cable attachable forearm cover assembly for performing upper body workouts without using a person's hands includes a sleeve that is worn on a forearm of a person. A securing unit is positioned on the sleeve and secures a hand of the person to the sleeve to inhibit the sleeve from sliding along the forearm. A plurality of attachment members is positioned on the securing unit and engages cabling of a weight lifting apparatus.

4 Claims, 5 Drawing Sheets

CABLE ATTACHABLE FOREARM COVER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to upper body workout devices and more particularly pertains to a new upper body workout device for performing upper body workouts without using a person's hands.

BRIEF SUMMARY OF THE INVENTION

An embodiment of the disclosure meets the needs presented above by generally comprising a sleeve that is configured to be worn on a forearm of a person. A securing unit is positioned on the sleeve and is configured to secure a hand of the person to the sleeve to inhibit the sleeve from sliding along the forearm. A plurality of attachment members is positioned on the securing unit and is configured engage cabling of a weight lifting apparatus.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
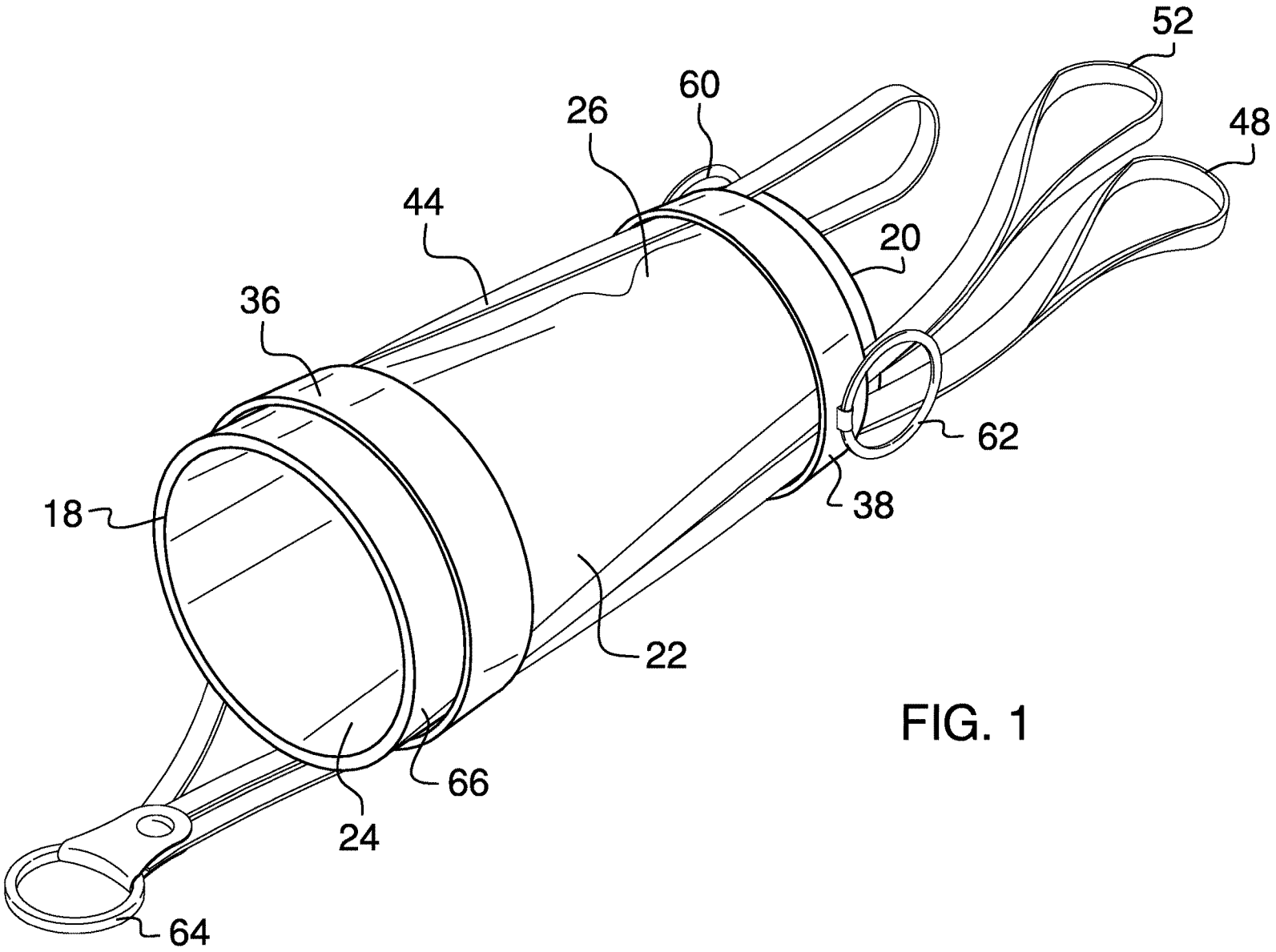
FIG. 1 is a top side view of a cable attachable forearm cover assembly according to an embodiment of the disclosure.
Figure 2:
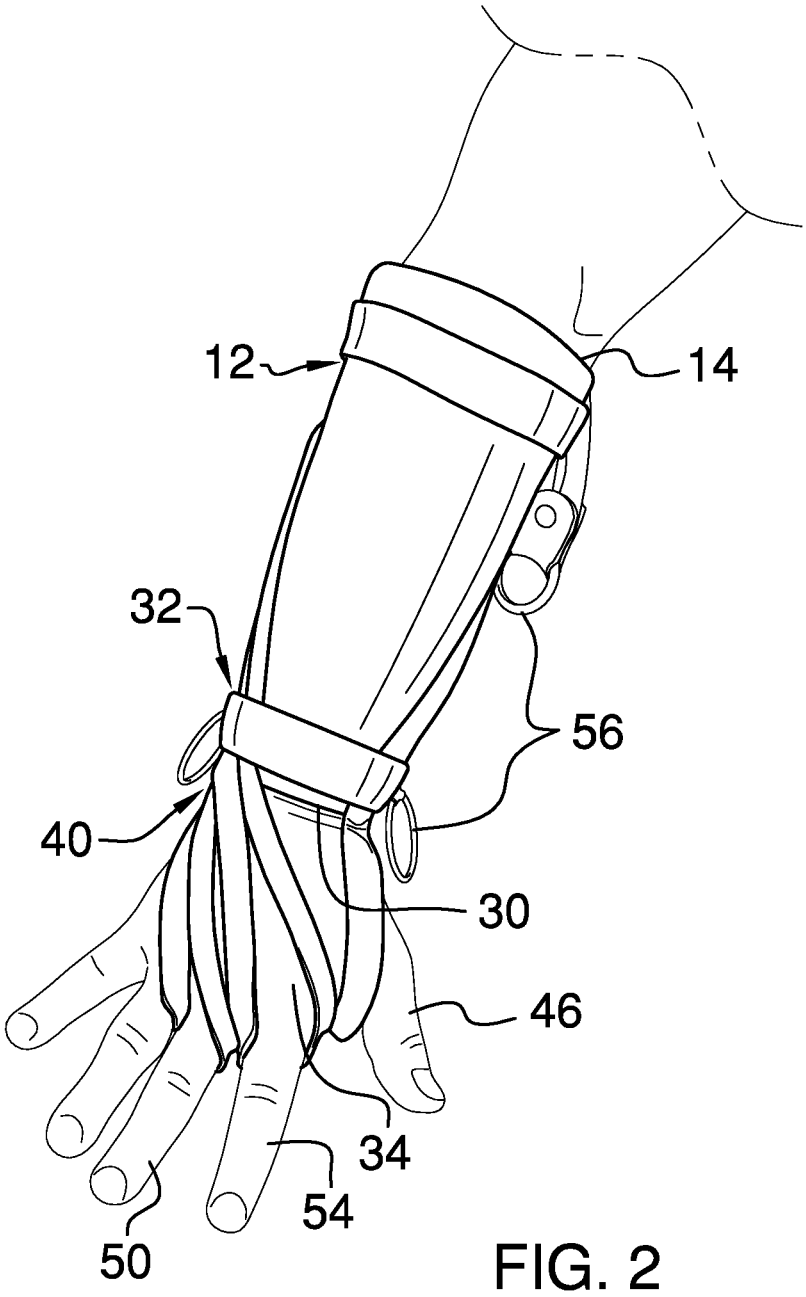
FIG. 2 is a front side view of an embodiment of the disclosure.
Figure 3:
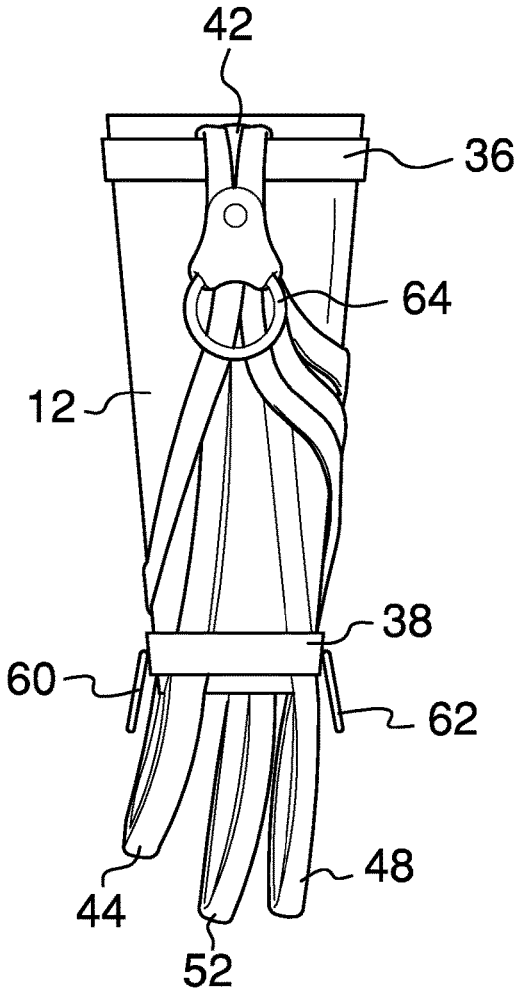
FIG. 3 is a back view of an embodiment of the disclosure.
Figure 4:
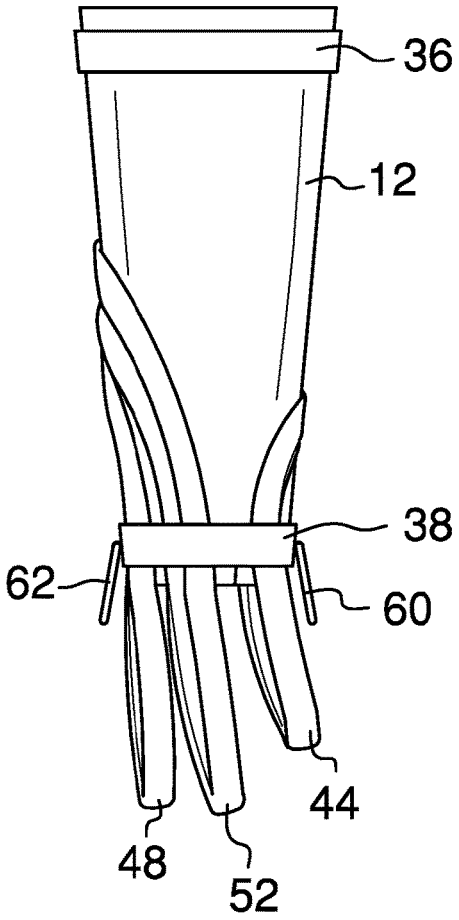
FIG. 4 is a front view of an embodiment of the disclosure.
Figure 5:
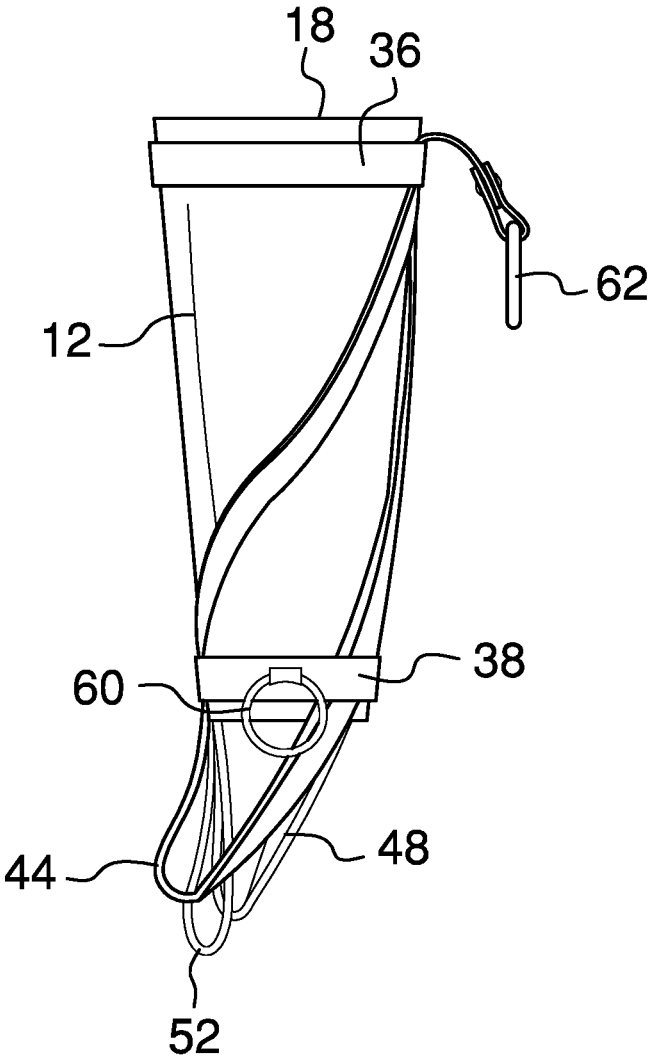
FIG. 5 is a side view of an embodiment of the disclosure.
Figure 6:
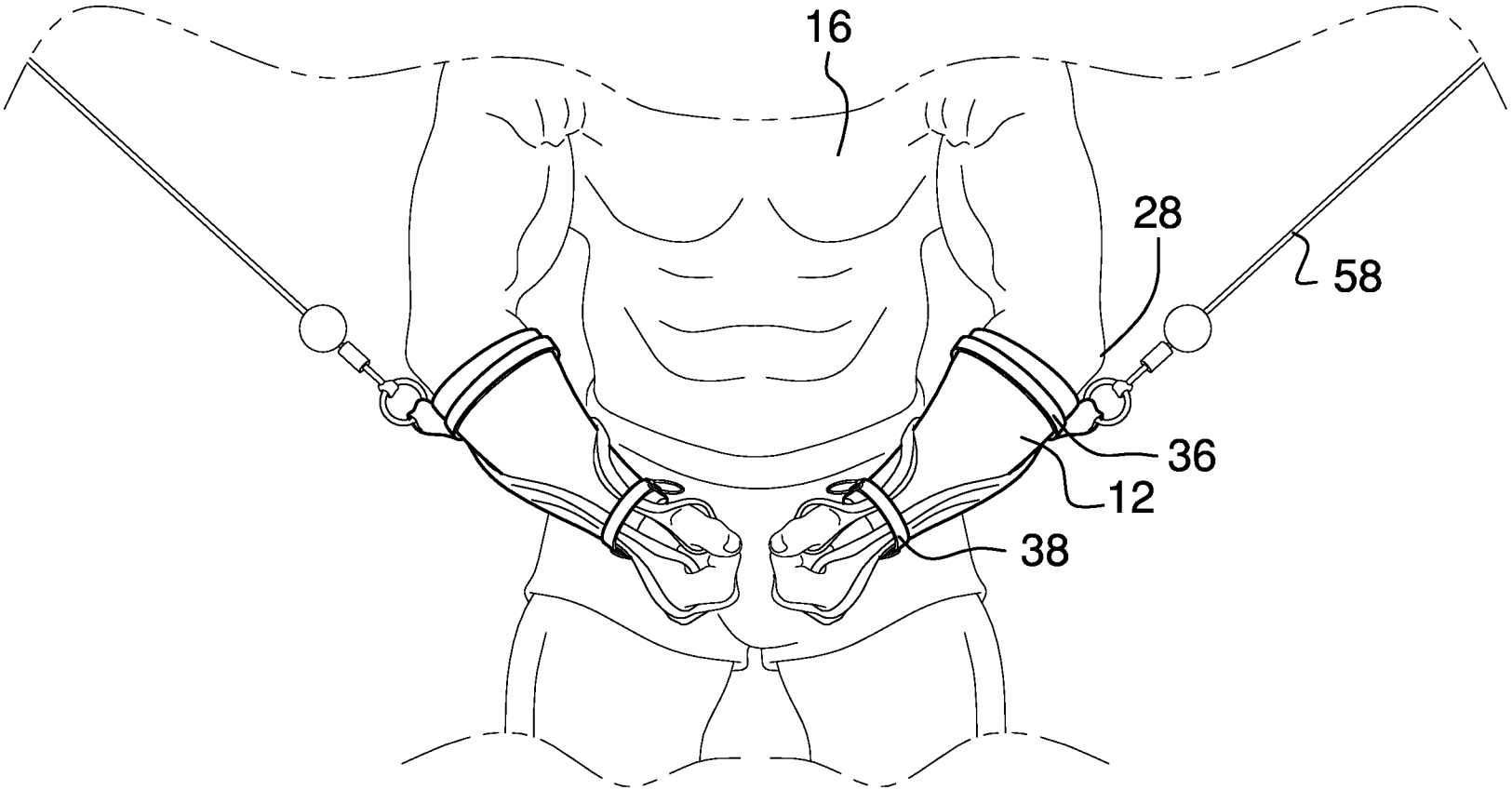
FIG. 6 is a side view of an embodiment of the disclosure.

With reference now to the drawings, and in particular to FIGS. 1 through 6 thereof, a new upper body workout device embodying the principles and concepts of an embodiment of the disclosure and generally designated by the reference numeral 10 will be described.

As best illustrated in FIGS. 1 through 6, the cable attachable forearm cover assembly 10 generally comprises a sleeve 12 that is worn on a forearm 14 of a person 16. The sleeve 12 has a first end 18, a second end 20 and a perimeter wall 22 that is attached to and extends between the first end 18 and the second end 20. The perimeter wall 22 has an inner surface 24 and an outer surface 26. Each of the first end 18 and the second end 20 is open wherein the sleeve 12 receives the person's forearm 14 such that the first end 18 is adjacent to an elbow 28 of the person 16 and the second end 20 abuts a wrist 30 of the person 16.

A securing unit 32 is positioned on the sleeve 12 and secures a hand 34 of the person 16 to the sleeve 12 to inhibit the sleeve 12 from sliding along the forearm 14. The securing unit 32 comprises a forearm strap 36 that is attached to the sleeve 12 and is positioned adjacent to the first end 18. The forearm strap 36 extends around the outer surface 26 of the sleeve 12 to form a closed loop. The forearm strap 36 secures the sleeve 12 to the person's forearm 14 and has a cylindrical shape.

A wrist strap 38 is attached to the sleeve 12 and is positioned adjacent to the second end 20. The wrist strap 38 extends around the outer surface 26 of the sleeve and forms a closed loop. The wrist strap 38 secures the sleeve 12 to the person's wrist 30 and has a cylindrical shape.

A hand coupler 40 secures the hand 34 to the sleeve 12 to inhibit the sleeve 12 from moving along the forearm 14. The hand coupler 40 is attached to the forearm strap 36 and the wrist strap 38. The hand coupler 40 extends outwardly from the second end 20 of the sleeve 12. The hand coupler 40 has a base portion 42 that is attached to the forearm strap 36. The base portion 42 is positioned between the forearm strap 36 and the sleeve 12. A thumb strap 44 is attached to and extends away from the base portion 42. The thumb strap 44 extends between the wrist strap 38 and the sleeve 12 and extends outwardly from the second end 20 of the sleeve 12. The thumb strap 44 forms a closed loop shape wherein a thumb 46 of the person 16 is positionable through the thumb strap 44 and thereby secures the person's thumb 46 to the thumb strap 44.

A middle finger strap 48 is attached to and extends away from the base portion 42. The middle finger 48 strap extends between the wrist strap 38 and the sleeve 12 and extends outwardly from the second end 20 of the sleeve 12. The middle finger strap 48 forms a closed loop shape wherein a middle finger 50 of the person 16 is positionable through the middle finger strap 48 and thereby securing the person's middle finger 50 to the middle finger strap 48.

An index finger strap 52 is attached to and extends away from the base portion 42. The index finger strap 52 extends between the wrist strap 38 and the sleeve 12 and extends outwardly from the second end 20 of the sleeve 12. The index finger strap 52 forms a closed loop shape wherein an index finger 54 of a person 16 is positionable through the index finger strap 52 and thereby secures the person's index finger 54 to the index finger strap 52.

A plurality of attachment members 56 is positioned on the securing unit 32 and engages cabling 58 of a weight lifting apparatus. The plurality of attachment members 56 includes a first attachment member 60, a second attachment member 62 and a third attachment member 64. The first attachment member 60 and second attachment member 62 are each positioned on the wrist strap 38 and positioned on opposite lateral sides of the sleeve 12 with respect to each other. The third attachment member 64 is positioned on the forearm strap 36. The third attachment member 64 is positioned on a top side 66 of the sleeve 12 and is offset with respect to the first attachment member 60 and the second attachment member 62.

In use, the forearm 14 of the person 16 is positioned through the sleeve 12 such that the first end 18 is adjacent to the person's elbow 28 and the second end 20 abuts the person's wrist 30. The person's thumb 46, middle finger 50 and index finger 54 are positioned through a corresponding one of the straps 44, 48, 52 of the hand coupler 40 such that the person's hand 34 secures the sleeve 12 from moving along the forearm 14. A selected one of the attachment members 56 is engaged to the cabling 58 of the weight lifting apparatus. The person 16 then performs the upper body exercise of the weight lifting apparatus using the forearm 14 for support instead of the person's hand 34. Each of the attachment members 56 are positioned such that each of the attachment members 56 provide a different angle of the cabling 58 relative to the weight lifting apparatus and thus provide the person 16 with a different upper body workout.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A gauntlet assembly configured to engage a weight lifting apparatus to facilitate performance of upper body exercises without the use of a person's hands, said gauntlet assembly comprising:

a sleeve being configured to be worn on a forearm of a person;

a securing unit being positioned on said sleeve and being configured to secure a hand of the person to said sleeve to inhibit said sleeve from sliding along the forearm; and a plurality of attachment members being positioned on said securing unit and being configured engage cabling of a weight lifting apparatus;

wherein said sleeve has a first end, a second end and a perimeter wall being attached to and extending between said first end and said second end, said perimeter wall having an inner surface and an outer surface, each of said first end and said second end being open wherein said sleeve is configured to receive the person's forearm such that said first end is adjacent to an elbow of the person and said second end abuts a wrist of the person; and wherein said securing unit comprises:

a forearm strap being attached to said sleeve and being positioned adjacent to said first end, said forearm strap extending around said outer surface of said sleeve forming a closed loop, said forearm strap being configured to secure said sleeve to the person's forearm, said forearm strap having a cylindrical shape;

a wrist strap being attached to said sleeve and being positioned adjacent to said second end, said wrist strap extending around said outer surface of said sleeve and forming a closed loop, said wrist strap being configured to secure said sleeve to the person's wrist, said wrist strap having a cylindrical shape; and a hand coupler being configured to secure the hand to said sleeve to inhibit said sleeve from moving along the forearm, said hand coupler being attached to said forearm strap and said wrist strap, said hand coupler extending outwardly from said second end of said sleeve.

2. The gauntlet assembly according to claim 1, wherein said hand coupler further includes:

a base portion being attached to said forearm strap, said base portion being positioned between said forearm strap and said sleeve;

a thumb strap being attached to and extending away from said base portion, said thumb strap extending between said wrist strap and said sleeve and extending outwardly from said second end of said sleeve, said thumb strap forming a closed loop shape wherein a thumb of the person is positionable through said thumb strap and thereby securing the person's thumb to said thumb strap;

a middle finger strap being attached to and extending away from said base portion, said middle finger strap extending between said wrist strap and said sleeve and extending outwardly from said second end of said sleeve, said middle finger strap forming a closed loop shape wherein a of the person middle finger is positionable through said middle finger strap and thereby securing the person's middle finger to said middle finger strap;

a index finger strap being attached to and extending away from said base portion, said index finger strap extending between said wrist strap and said sleeve and extending outwardly from said second end of said sleeve, said index finger strap forming a closed loop shape wherein an index finger of the person is positionable through said index finger strap and thereby securing the person's index finger to said index finger strap.

3. The gauntlet assembly according to claim 1, wherein said plurality of attachment members includes a first attachment member, a second attachment member and a third attachment member, said first attachment member and second attachment members each being positioned on said wrist strap, said first attachment member and said second attachment member being positioned on opposite lateral sides of said sleeve with respect to each other, said third attachment member being positioned on said forearm strap, said third attachment member being positioned on a top side of said sleeve and being offset with respect to said first attachment member and said second attachment member.

4. A gauntlet assembly configured to engage a weight lifting apparatus to facilitate performance of upper body exercises without the use of a person's hands, said gauntlet assembly comprising:

a sleeve being configured to be worn on a forearm of a person, said sleeve having a first end, a second end and a perimeter wall being attached to and extending between said first end and said second end, said perimeter wall having an inner surface and an outer surface, each of said first end and said second end being open wherein said sleeve is configured to receive the person's forearm such that said first end is adjacent to an elbow of the person and said second end abuts a wrist of the person;

a securing unit being positioned on said sleeve and being configured to secure a hand of the person to said sleeve to inhibit said sleeve from sliding along the forearm, said securing unit comprising:

a forearm strap being attached to said sleeve and being positioned adjacent to said first end, said forearm strap extending around said outer surface of said sleeve forming a closed loop, said forearm strap being configured to secure said sleeve to the person's forearm, said forearm strap having a cylindrical shape;

a wrist strap being attached to said sleeve and being positioned adjacent to said second end, said wrist strap extending around said outer surface of said sleeve and forming a closed loop, said wrist strap being configured to secure said sleeve to the person's wrist, said wrist strap having a cylindrical shape;

a hand coupler being configured to secure the hand to said sleeve to inhibit said sleeve from moving along the forearm, said hand coupler being attached to said forearm strap and said wrist strap, said hand coupler extending outwardly from said second end of said sleeve, said hand coupler having:

a base portion being attached to said forearm strap, said base portion being positioned between said forearm strap and said sleeve;

a thumb strap being attached to and extending away from said base portion, said thumb strap extending between said wrist strap and said sleeve and extending outwardly from said second end of said sleeve, said thumb strap forming a closed loop shape wherein a thumb of the person is positionable through said thumb strap and thereby securing the person's thumb to said thumb strap;

a middle finger strap being attached to and extending away from said base portion, said middle finger strap extending between said wrist strap and said sleeve and extending outwardly from said second end of said sleeve, said middle finger strap forming a closed loop shape wherein a middle finger of the person is positionable through said middle finger strap and thereby securing the person's middle finger to said middle finger strap;

a index finger strap being attached to and extending away from said base portion, said index finger strap extending between said wrist strap and said sleeve and extending outwardly from said second end of said sleeve, said index finger strap forming a closed loop shape wherein an index finger of the person is positionable through said index finger strap and thereby securing the person's index finger to said index finger strap; and a plurality of attachment members being positioned on said securing unit and being configured engage cabling of a weight lifting apparatus, said plurality of attachment members including a first attachment member, a second attachment member and a third attachment member, said first attachment member and second attachment members each being positioned on said wrist strap, said first attachment member and said second attachment member being positioned on opposite lateral sides of said sleeve with respect to each other, said third attachment member being positioned on said forearm strap, said third attachment member being positioned on a top side of said sleeve and being offset with respect to said first attachment member and said second attachment member.

* * * * *